United States Patent [19]

Kienlen et al.

[11] 4,399,805

[45] Aug. 23, 1983

[54] PANEL INSULATION APPARATUS

[76] Inventors: Loren C. Kienlen, 225 Banton Ave.; Thomas L. McDonell, 2795 Chuckanut St., both of Eugene, Oreg. 97404

[21] Appl. No.: 278,848

[22] Filed: Jun. 29, 1981

[51] Int. Cl.[3] ..... F24B 7/00

[52] U.S. Cl. ..... 126/121; 126/202; 126/279; 126/316; 432/65; 237/52; 237/79; 165/55

[58] Field of Search ..... 126/120, 121, 201, 202, 126/277–279, 307 R, 312, 316, 80; 237/51, 55, 52, 79; 29/157.3 D, 150, 157 R; 52/404, 406, 407; 165/169–172

[56] References Cited

U.S. PATENT DOCUMENTS

| | | | |
|---|---|---|---|
| 2,231,258 | 2/1941 | Elmore | 237/51 |
| 2,693,636 | 11/1954 | Simpelaar | 29/157.3 D |
| 3,046,976 | 7/1962 | Aggson | 126/316 |
| 3,156,298 | 11/1964 | Gardiner et al. | 165/169 |
| 4,008,705 | 2/1977 | Robertson | 126/121 |
| 4,217,094 | 8/1980 | Crowley | 126/202 |
| 4,295,460 | 10/1981 | Wilson | 126/202 |

FOREIGN PATENT DOCUMENTS

| | | | |
|---|---|---|---|
| 2712487 | 9/1978 | Fed. Rep. of Germany | 237/79 |
| 1357410 | 4/1964 | France | 237/79 |
| 2031577 | 4/1980 | United Kingdom | 237/79 |
| 1573904 | 8/1980 | United Kingdom | 126/316 |

*Primary Examiner*—James C. Yeung

*Attorney, Agent, or Firm*—Klarquist, Sparkman, Campbell, Leigh, Whinston & Dellett

[57] ABSTRACT

Protective panels are disclosed for insulating walls and other combustible surfaces from a nearby stove or other heating device. Simple, economical shallow U-shaped pieces, one positioned upon the other, create two distinct conduits through which air flows upwardly. Also, the panels reflect radiant heat back towards the stove or other heat source and away from the area protected. A plurality of these double conduit panel members provide an insulating barrier between the heat source and the combustible surface to cover areas of any desired size.

3 Claims, 17 Drawing Figures

PANEL INSULATION APPARATUS

BACKGROUND OF THE INVENTION

The present invention relates to devices for shielding combustible surfaces from excessive temperatures such as may be created from nearby stoves or other heat producing devices.

Most building codes require that a stove be positioned a substantial distance away from a combustible wall and hence out toward the center of a room, which in many instances is objectionable.

One object of this invention is to protect a combustible surface, such as a wall or divider, so that a heat source can be positioned relatively close to such a surface without causing the temperature of such a wall to exceed acceptable limits.

Another object is to provide a panel insulating apparatus of lightweight non-combustible materials of a design and size making them easy to install, store and transport.

A further object is to provide a panel insulating apparatus defining plural upright conduits within which airflow will be created of sufficient velocity to conduct heat from the wall being protected, to maintain such wall at desirably low temperatures.

Still another object is to provide a panel insulating apparatus of a decorative nature which enhances the appearance of the stove area and of such a geometry that a plurality will cover any area desired.

A further object of the invention is to provide a panel insulating apparatus of economical construction.

Other objects and advantages will appear hereinafter.

DESCRIPTION OF PREFERRED EMBODIMENTS

Figure 1:
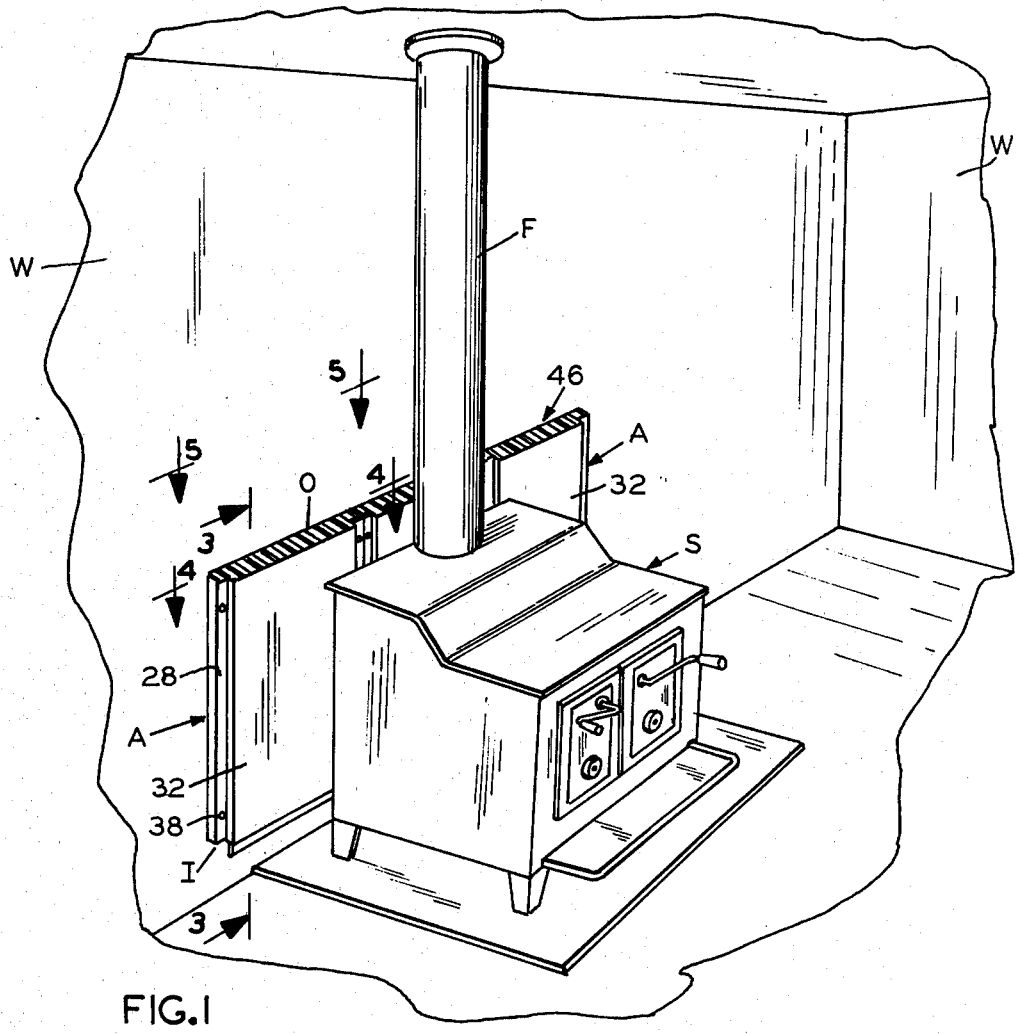
FIG. 1 is a perspective view of a stove and a plurality of insulating panels mounted on an adjacent wall.
Figure 5:
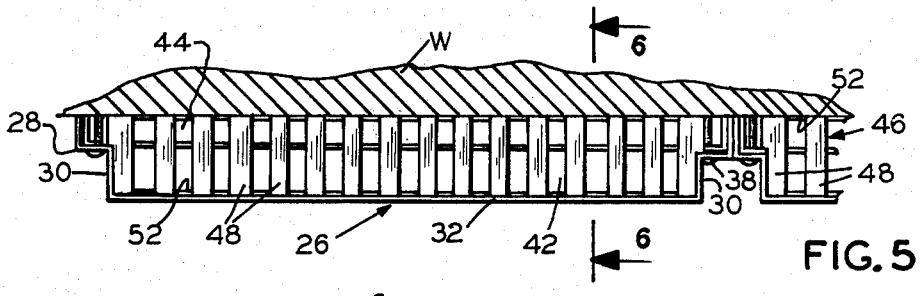
FIG. 5 is a plan view of the top air outlet of one panel as viewed along line 5—5 of FIG. 1.

Referring to the drawings in detail, there is shown in FIG. 1 a stove S positioned relatively close to a combustible wall W. A plurality of protective panels A are positioned on the wall in the manner shown to provide an insulating barrier between the stove S and the wall W. It should be noted that the area covered by the panels A is confined to that portion of the combustible wall directly behind the heat source. Also, the panels are open at their lower ends, near the floor, and at their upper ends. Thus, air in a room will enter the bottom of each panel at an inlet I and be drawn upwardly through the panels. Heated air within the panels rises and is discharged from an outlet O at the top of the panels. This creates airstreams which continuously sweep or bathe the combustible wall W to prevent excessive temperature buildup of the wall.

Figure 2:
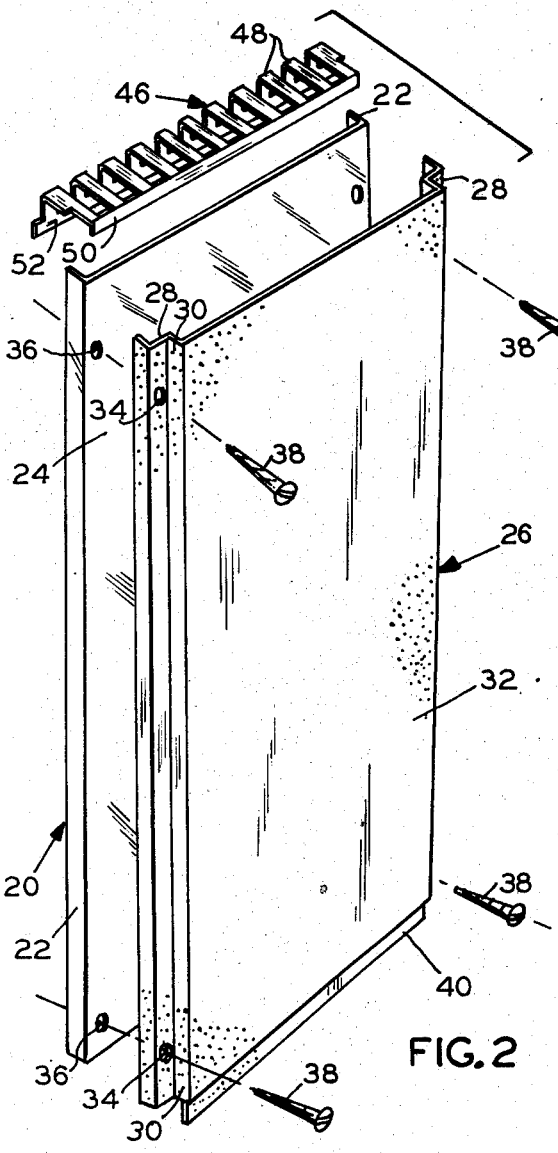
FIG. 2 is an exploded, perspective view of one of the panels.
Figure 4:
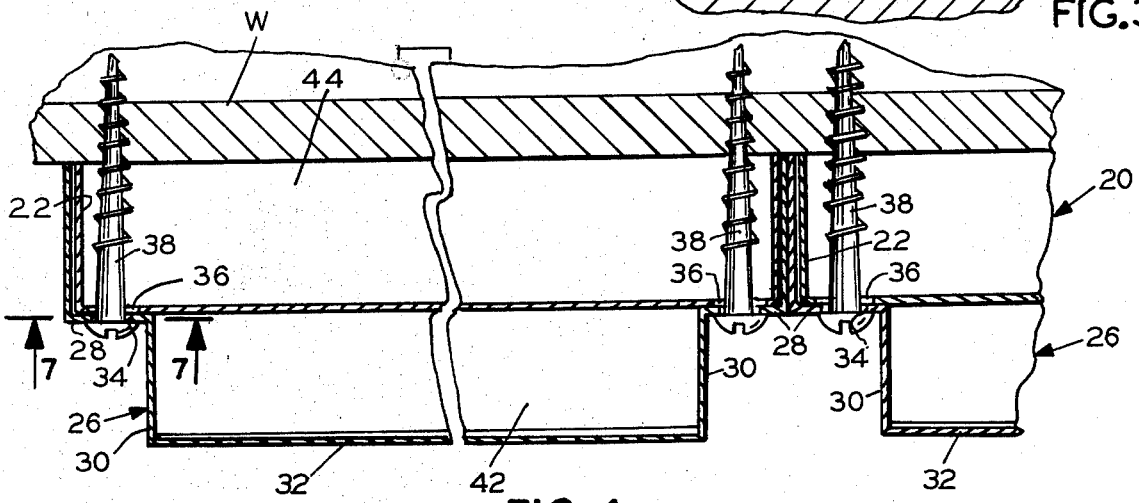
FIG. 4 is a fragmentary horizontal sectional view taken along line 4—4 of FIG. 1.

The structural details of one form of a panel A are best seen in FIG. 2 and FIG. 4, wherein an inner panel member 20 is formed out of a single rectangular sheet of suitable non-combustible material, in this structure, a metallic material. The elongated panel 20 is formed in a shallow U-shape with rather narrow side legs 22 and a wall 24 having planar or flat front and rear surfaces. The front surface of wall 24 is preferably of a heat reflective character, such as the case if the wall is formed of galvanized metal, or of other shiny, bright reflective metal, or if the front surface of the wall is coated with a reflective material.

Panel A also includes an outer panel member 26 preferably formed of one piece of rectangular sheet material of the same length as the inner panel 20. Panel member 26 includes an offset shoulder side portion 28 embracing the legs 22 and the side margins of the wall 24 of the inner panel member 20, as best seen in FIG. 4. Right angle side portions 30 project outwardly from shoulder side portions 28 and together with front wall 32 form a smooth decorative panel, which may be painted or otherwise decorated to blend with home decor. Apertures 34 in the offset shoulders 28 align with apertures 36 in the wall 24 of the inner panel member 20. The apertures 36 are larger than apertures 34 to allow for greater expansion of panel member 20, thus preventing buckling or distortion when subject to temperature rise. The panels are held in assembly and secured to the wall by common fasteners 38, such as wood screws. The front wall 32 of the panel member 26 has a lip 40 offset inwardly from the front wall 32 toward wall W, and extending from the bottom thereof. The function of this lip 40 will be more fully described later in the application.

As seen in FIG. 4 two distinct conduits are formed when the aforedescribed structure is assembled and placed on a combustible wall surface, a primary conduit 42 which is closest to the heat source and a secondary conduit 44. The panel members 20, 26 are preferably so formed that these conduits have a depth of between about three-fourths inches and one and three-fourths inches, preferably about one inch to one and one-fourth inches. In U.L. Laboratory testing with conduits of one inch depth, temperatures in excess of 500 degrees Farenheit registered on the front or exposed outer surfaces of wall 32 caused only about a 40 degree Fahrenheit temperature rise above an ambient temperature of about 65 degrees Fahrenheit, on the combustible surface. The stove in these tests was positioned nine and one-half inches from the combustible surface.

Figure 3:
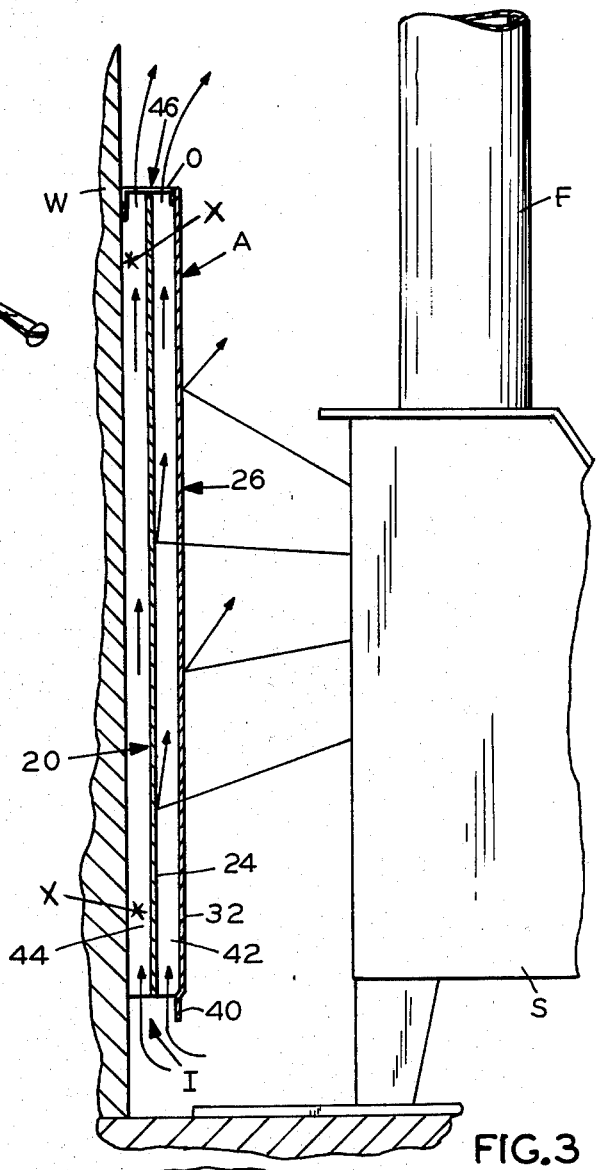
FIG. 3 is a vertical sectional view taken along line 3—3 of FIG. 1.

As viewed in FIG. 3, heat is radiated from the front reflective surface of wall 24, and also from the rear surface of panel wall 32, and heats air with conduit 42. The reflective character of the front surface of wall 24 tends to confine heat within this conduit, so that it does not reach the combustible wall. The heated air rises, within conduit 42 as does heated air within conduit 44, and is replaced by cooler air drawn off the floor area through lower inlet I. This rising heated air escapes through top outlets O, and is constantly replaced by cooler air, thus minimizing the temperature rise on the wall surface that is being shielded. Enhanced cooling of this wall W results when panel wall 32 is coated with a black material or is otherwise constructed of a material which tends to absorb heat, while wall 24 is of a reflective material. This results in increased heating of air with conduit 42 and a corresponding increase in convection air flow through this conduit.

Figure 6:
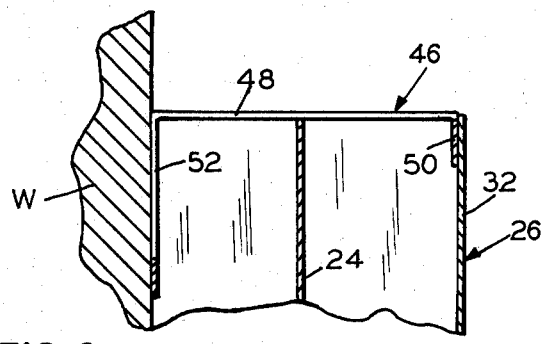
FIG. 6 is a sectional view taken along line 6—6 of FIG. 5.
Figure 7:
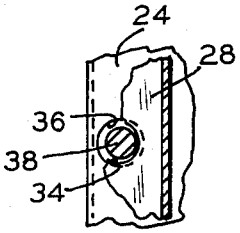
FIG. 7 is a fragmentary partial sectional view taken along line 7—7 of FIG. 4.

A decorative grill 46 is provided to cover the top outlet. This grill prevents large objects from falling into and blocking the conduits, as well as improves the aesthetic appearance of the apparatus. The grill 46 is formed by a series of parallel spaced bars 48 which are interconnected by a short front leg 50 and a longer rear leg 52. Thus, alternating bars and air outlet spaces 54 are provided as can be seen in FIG. 2. When capping the panels with the grill, as seen in FIG. 6, the long leg 52 is placed against the wall W and the shorter leg against the rear surface of the wall 32 of the front panel 26. Also, grill 46 rests on the upper edge of inner panel wall 24. The grill is dimensioned so that it is slightly wider than the distance from wall W to wall 32. This comprises one form of means as, when installed, a slight spring action holds the grill in position.

Figure 8:
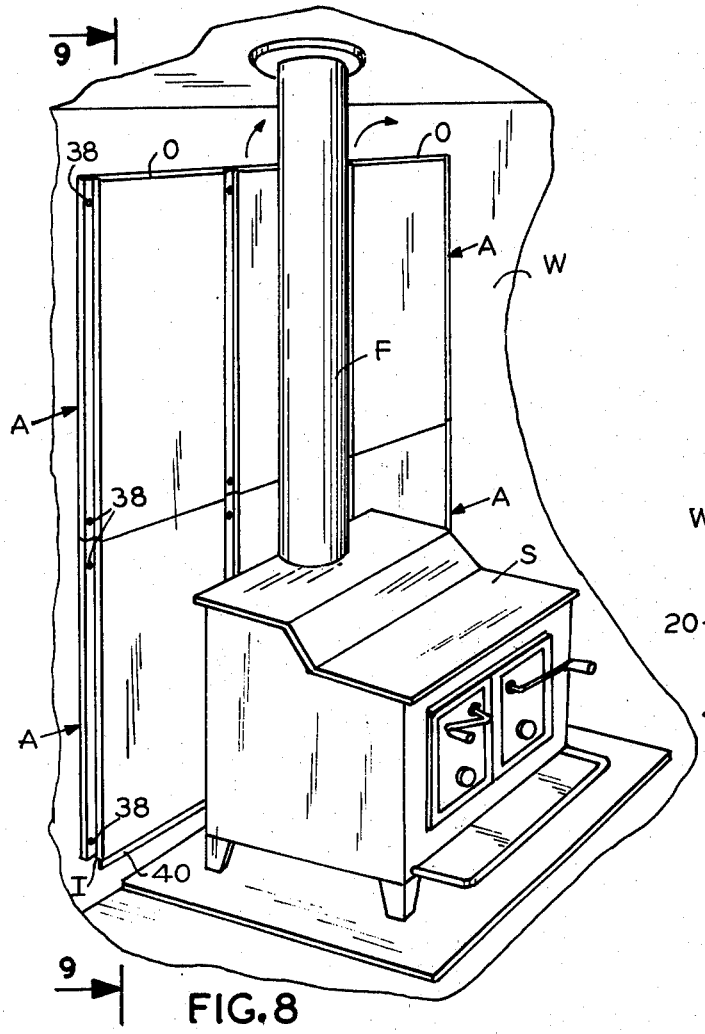
FIG. 8 is a perspective view of an alternate embodiment of the invention.
Figure 9:
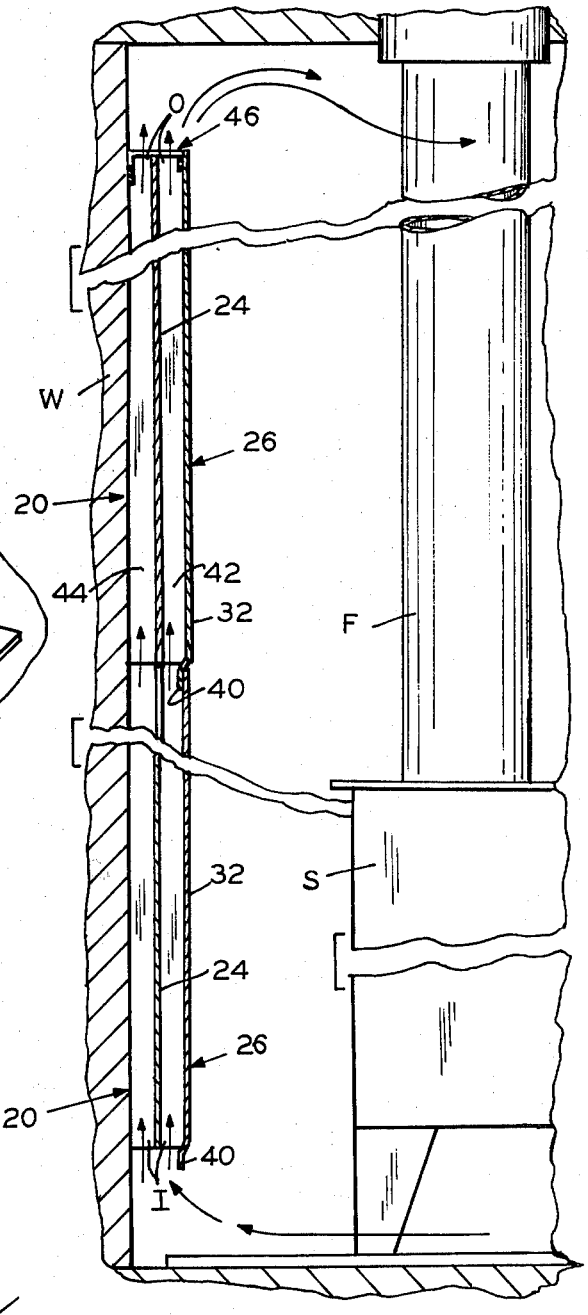
FIG. 9 is a vertical sectional view taken along line 9—9 of FIG. 8.

FIG. 8 illustrates a method of stacking a plurality of panels to cover a greater area, such as may be desired in applications in which high temperatures are expected within a flue from exhaust gases. The offset lip 40 at the bottom of the wall 32 of each top panel A is positioned behind and engages the upper margin of the wall 32 of the respective panel A immediately below it. This is best seen in FIG. 9, and results in substantially sealed vertical conduits 42, 44 extending from top to bottom of each pair of upper and lower interlocking panels.

Figure 10:
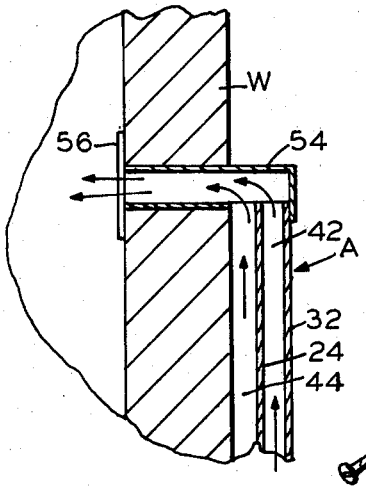
FIG. 10 is a sectional view showing means of diverting airflow into a room separated from the room containing the stove.

Referring to FIG. 10, there is shown an apparatus for directing the rising hot air flow exhausting from the upper ends of the panels through the wall W and into another room. Instead of grill 46, the top of the panel A is capped with an air directing conduit, such as an elbow 54 which projects through wall W and defines an air flow passageway having an outlet opening covered by a register 56.

Under test conditions, a monometer registered air flowing through a sixteen square inch conduit 54, the heated air rising within the conduits 42, 44, of two-hundred ten cubic feet per minute. This flow is sufficient to distribute heated air through additional conduits to other rooms. Of course, if allowed to flow freely from the top outlets O, this flow results in distribution of warm air more evenly through a room area.

Figure 11:
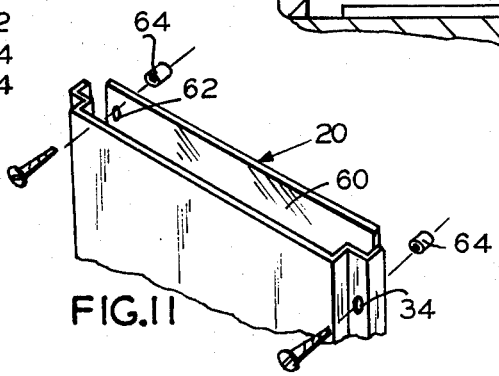
FIG. 11 is a perspective view of an alternate inner panel member construction in accordance with the invention.

FIG. 11 illustrates an alternate construction of an inner panel member 20 consisting of a flat rectangular piece of material 60, preferably of sheet metal. In this assembly, apertures 62 through sheet 60 are aligned with apertures 34 in outer panel member 26. Standoffs 64, such as of an insulating non-metallic material, hold the sheet 60 against the shoulder portion 28 of the outer panel member 26 and also away from wall W. Thus, the assembled structure provides the same primary and secondary conduits 42, 44 as illustrated in the embodiment described above.

Figure 12:
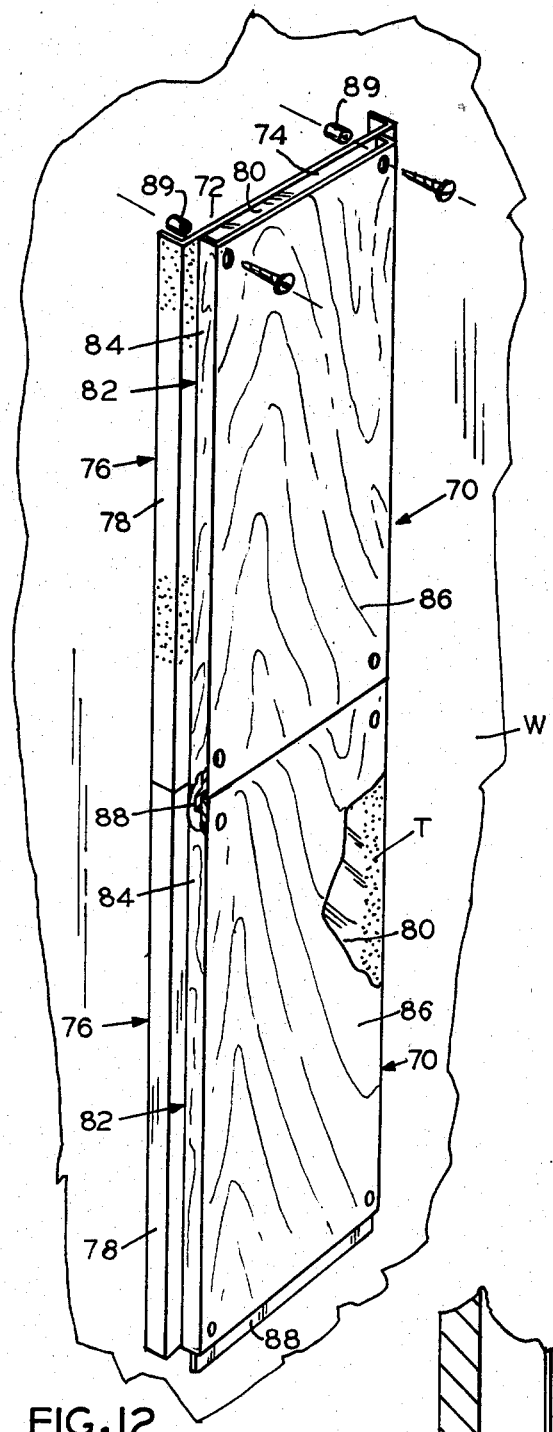
FIG. 12 is a perspective view showing another alternate panel construction.

FIG. 12 shows a modified version 70 of an insulating panel assembly which defines two distinct air flow conduits 72 and 74 and operates as previously described. In this construction, a first shallow U-shaped channel member 76 is positioned adjacent the wall W with the side legs 78 of the member abutting the wall and with its base of panel wall portion 80 spaced from the wall. A second shallow U-shaped channel member 82, narrower than the panel wall 80 is provided with side legs 84 and a panel wall 86. Panel member 82 is mounted to panel member 76, as explained below, with legs 84 of panel member 82 abutting the front wall 80 of panel member 76. Thus, conduit 74 is defined by the interior surfaces of panel member 84, together with a major portion of the front surface of panel wall 80. The surfaces of panel member 82 may be decorated in any suitable manner. When installed, the wide inner panel member 76 in effect frames the outer panel member 82. The exposed portion of the inner panel member may be of a contrasting color or texture T to enhance the appearance of the device. The remainder of the front surface of the inner panel wall 80, which is overlaid by panel member 82, is preferably reflective. A lower lip 88 is provided, as shown in FIG. 12, and offset to interlock with the interior upper margin of wall 86 in the manner previously described in connection with the construction of FIG. 1. Suitable panel securing means are utilized, such as wood screws. Spacers 89 may also be used as previously described.

Figure 13:
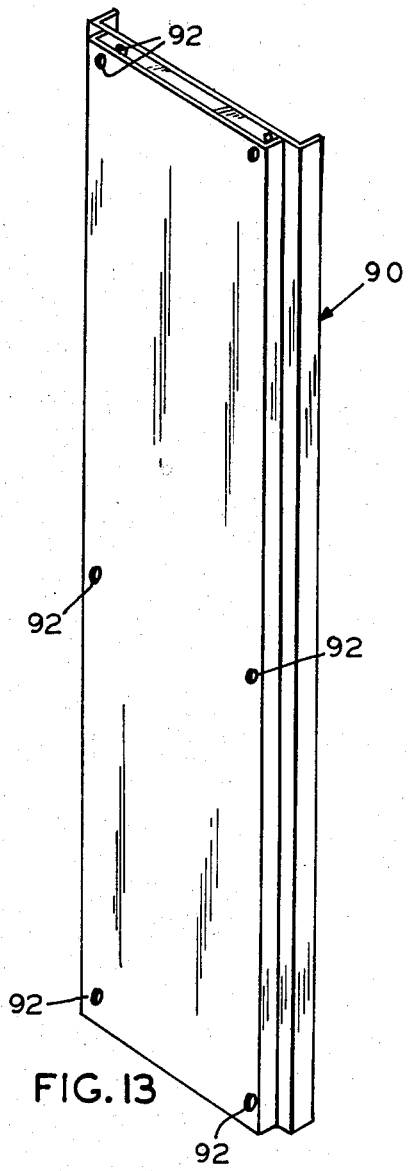
FIG. 13 is a perspective view of another type of panel in accordance with the invention.

FIG. 13 shows a panel structure 90 which is similar in cross section to that shown in FIG. 12. However, the FIG. 13 construction is elongated and does not have a lower lip. This elongated panel may be used behind flues to protect a narrow region of the wall directly behind the flue pipe area. Also, shorter panels, such as 70 in FIG. 12, may be along each side of panel 90 and behind the stove or other heat source to provide added protection. Apertures 92 through the panels 90 are provided through which fasteners are inserted to secure the panel to the wall surface as described in connection with FIG. 12.

Figure 14:
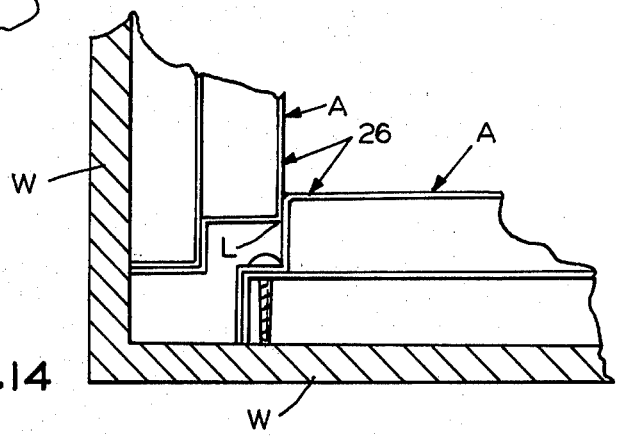
FIG. 14 is a fragmentary plan view showing a method of corner installation of panels.

FIG. 14 shows a method of corner installation of panels A. A first of such panels is mounted to one wall forming the corner, while a second of such panels is mounted to the other corner wall. These panels are positioned so that the outer panel member 26 abut as at L, and shield the room corner of the structure from the heat source.

Figure 15:
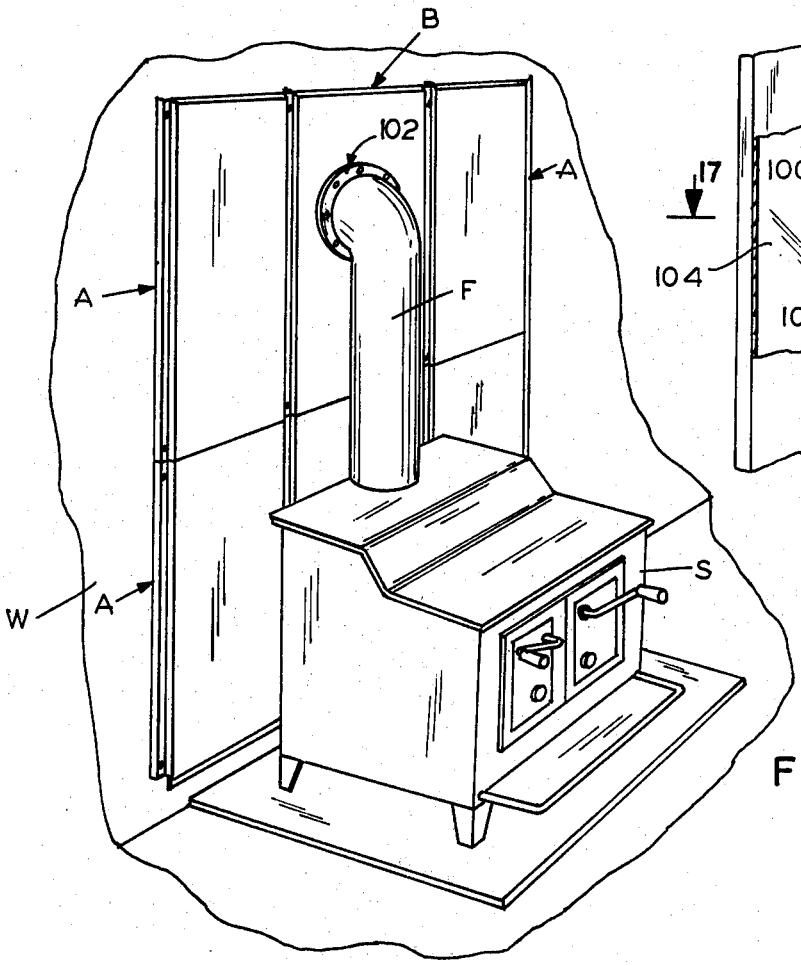
FIG. 15 is a perspective view showing a stove exhausting through a panel.
Figure 16:
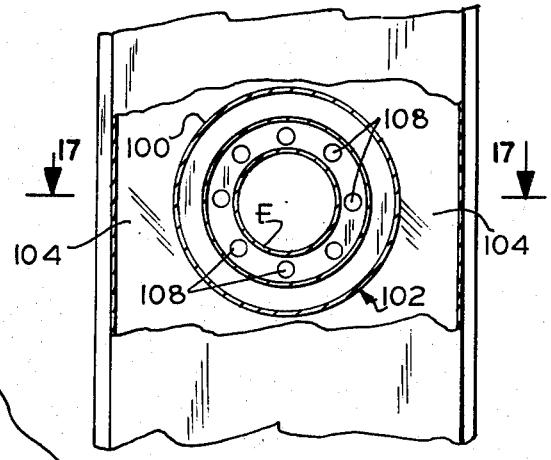
FIG. 16 is an elevational view of the panel of FIG. 15 with a portion of the front wall broken away.
Figure 17:
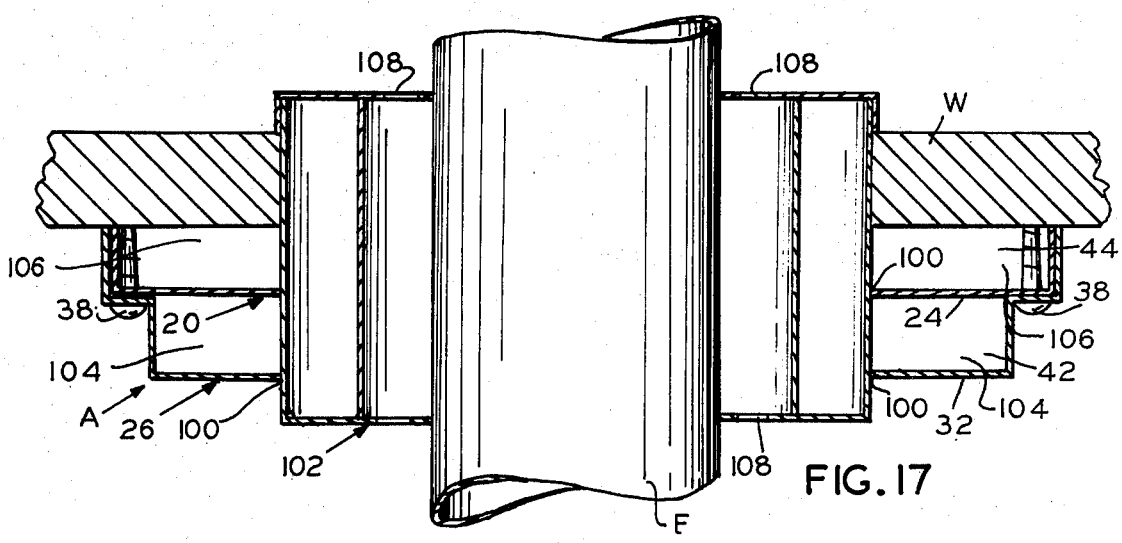
FIG. 17 is a sectional view taken along line 17—17 of FIG. 16.

FIGS. 15, 16, 17 show a flue F exhausting through a panel assembly B, which is similar to those assemblies already described. A cylindrical hole 100 is provided through walls 24 and 32 of the respective panel members 20, 26 and through the wall W which is to be protected. A thimble 102, of which several varieties are commercially available, is inserted into opening 100 and through the panel members 20, 26 and the wall. A flue or stove pipe passes through this thimble and is insulated from the combustible wall surface. Clearance areas 104 and 106 are provided at the sides of the thimble to allow heated air rising in conduits 42, 44 to flow past the thimble. Aperture 108 may be provided through the thimble to enhance air circulation and cooling of the flue.

Having illustrated and described the principles of our invention by what are presently preferred embodiments and several embodiments, it should be apparent to those persons skilled in the art that such embodiments may be modified in scope, arrangement and detail without departing from such principles. We claim as our invention all such modifications as come written in the true spirit and scope of the following claims.

We claim:

1. In combination with a wall, a panel for insulating such wall from a stove or like heat source, said panel comprising an inner elongate panel member of U-shaped cross-section and having a wall portion spaced from and parallel to said wall and opposite vertically extending first side legs extending from said wall portion to said wall thereby to define with said wall a vertically extending channel, an outer elongate panel member of generally U-shaped cross-section having a front wall portion spaced from and extending parallel to said inner panel member wall portion, said front wall portion being of narrower width than said inner panel member wall portion, said outer panel member having opposite second side legs, each having a first portion extending perpendicularly to and between said inner and outer panel member wall portions, a second portion extending outwardly from said first portion and parallel to said inner panel member wall portion in engagement therewith, and a third portion extending parallel to said first portion toward said wall in engagement with the outer surface of said first legs, and a plurality of fasteners extending through said second leg portions and said inner panel member wall portion and into said wall thereby to secure said panel members to said wall and to provide a pair of parallel channels for the conduction of air therethrough.

2. The combination of claim 1 wherein the outer surface of said front wall portion is provided with a heat absorbing coating.

3. The combination of claim 2 wherein the outer facing surface of said wall portion is provided with a heat reflective surface.

* * * * *